US005536187A

United States Patent [19]

Nanami

[11] Patent Number: 5,536,187

[45] Date of Patent: Jul. 16, 1996

[54] OUTBOARD JET DRIVE FOR WATERCRAFT

[75] Inventor: Masayoshi Nanami, Hamamatsu, Japan

[73] Assignee: Sanshin Kogyo Kabushiki Kaisha, Hamamatsu, Japan

[21] Appl. No.: 310,667

[22] Filed: Sep. 22, 1994

[30] Foreign Application Priority Data

Sep. 22, 1993 [JP] Japan ..... 5-257491

[51] Int. Cl.[6] ..... B63H 11/00

[52] U.S. Cl. ..... 440/38; 440/900; 440/53

[58] Field of Search ..... 440/38, 47, 53, 440/55–57, 46, 900; 60/221, 222

[56] References Cited

U.S. PATENT DOCUMENTS

| | | | |
|---|---|---|---|
| 2,917,019 | 12/1959 | Krueger | 440/56 |
| 2,975,750 | 3/1961 | Smith | 440/56 |
| 3,112,610 | 12/1963 | Jerger | 440/900 |
| 3,283,737 | 11/1966 | Gongwer | 60/222 |
| 3,702,485 | 11/1972 | Thompson | 440/900 |
| 3,807,344 | 4/1974 | Giacosa | 440/88 |
| 4,437,841 | 3/1984 | Stallman | 440/38 |

FOREIGN PATENT DOCUMENTS

| | | | |
|---|---|---|---|
| 4020172 | 1/1991 | Germany | 440/38 |
| 724662 | 11/1966 | Italy | 440/38 |
| 50-12672 | 5/1975 | Japan | 440/38 |

*Primary Examiner*—Edwin L. Swinehart
*Attorney, Agent, or Firm*—Knobbe, Martens, Olson & Bear

[57] ABSTRACT

A jet propelled watercraft having an outboard motor type of jet propulsion unit. The jet propulsion unit is disposed in substantial part forwardly of the transom and beneath the undersurface of the hull for improving its pumping efficiency. The jet propulsion unit is driven by a transmission including a drive shaft having a pivotal joint. The jet propulsion unit is pivotal relative to the engine about an axis containing the axis of the universal joint so that the water inlet opening may be swung upwardly through an opening in the undersurface of the hull which is above the water level for clearing foreign objects from the jet propulsion unit water inlet opening.

28 Claims, 3 Drawing Sheets

OUTBOARD JET DRIVE FOR WATERCRAFT

BACKGROUND OF THE INVENTION

This invention relates to an outboard jet drive for a watercraft and more particularly to an improved drive of this type.

There have been proposed types of outboard jet drives for watercraft which are basically similar to an outboard motor having a propeller. However, rather than incorporating a propeller in the lower unit, the jet drive includes a jet pump in the lower unit that operates so as to provide a propulsion force for the watercraft.

As is known, there are some advantages in employing such jet pumps for propulsion units as opposed to propellers. Conventionally, the jet drive permits operation in shallower water and also, because the impeller is shrouded, there is less likelihood of injury.

However, the flow of water into the water inlet of the jet pump is very important in the performance of the watercraft. If the jet pump has its water inlet disposed rearwardly of the transom, as is typical with outboard motor practice, then cavitation can occur. That is, the undersurface of the hull at the transom gives rise to a parting of the water, which will direct the water away from the inlet of the jet pump and cause cavitation and loss of performance.

Although various proposed constructions have been suggested for positioning the jet pump forwardly relative to the transom, there still exists some gap between the underside of the hull to the rear of the transom and the water inlet opening of the jet propulsion unit that can give rise to this cavitation.

It is, therefore, a principal object of this invention to provide an improved jet propulsion out drive unit for a watercraft wherein the jet pump can operate more efficiently.

It is a further object of this invention to provide an outboard jet propulsion unit for a watercraft wherein the water inlet of the jet pump is actually disposed beneath the hull of the watercraft to improve pumping efficiency.

The very nature of jet propulsion units, which permits them to operate in shallow water, gives rise to certain ancillary problems. Because these units can be utilized in shallow water, they are so used as a result. Frequently the water inlet opening of the jet pump can become clogged. With an outboard motor it is possible to tilt the outboard motor up about its tilt and trim axis and access the propeller for clearing it. With a jet propulsion unit, however, the water inlet opening to the jet propulsion unit normally faces downwardly, and when the outboard drive is tilted up, the water inlet opening will be not only spaced further rearwardly from the transom, but also will face away from the transom, making cleaning difficult.

It is, therefore, a still further object of this invention to provide an improved jet propulsion unit for a watercraft wherein the jet propulsion unit can be easily accessed for servicing.

It is another object of this invention to provide an improved jet propulsion unit for a watercraft wherein the water inlet opening of the jet pump can be easily swung up for access.

SUMMARY OF THE INVENTION

A first feature of the invention is adapted to be embodied in a jet propulsion system for a watercraft that is comprised of a hull having a transom and a hull undersurface disposed forwardly of the transom. The jet propulsion system comprises an internal combustion engine and an engine mount for mounting the internal combustion engine on the transom and at least partially to the rear thereof. The jet propulsion system further includes a jet propulsion unit having an outer housing defining a generally downwardly facing water inlet opening, a rearwardly facing discharge opening, and an impeller cavity. An impeller is journaled within the impeller cavity for pumping water from the inlet opening to the discharge opening for generating a propulsion force to the watercraft. Means are provided for mounting the jet propulsion unit from the engine mount and beneath the engine with at least the water inlet opening extending forwardly of the transom and at least in part beneath the hull undersurface. Transmission means are provided for driving the impeller from the engine.

Another feature of the invention is adapted to be embodied in a jet propelled watercraft having a hull with an undersurface. A recess is formed in the undersurface. A jet propulsion unit comprised of an outer housing defining a downwardly facing water inlet opening, a discharge opening, and an impeller cavity for containing an impeller for pumping water from the water inlet opening to the discharge opening for generating a propulsion force is provided. Support means support this jet propulsion unit at least in part within the recess for pivotal movement about an axis extending transversely to the hull and disposed rearwardly of the water inlet opening for raising the water inlet opening out of the body of water in which the watercraft is operating.

DETAILED DESCRIPTION OF THE PREFERRED EMBODIMENT OF THE INVENTION

Figure 1:
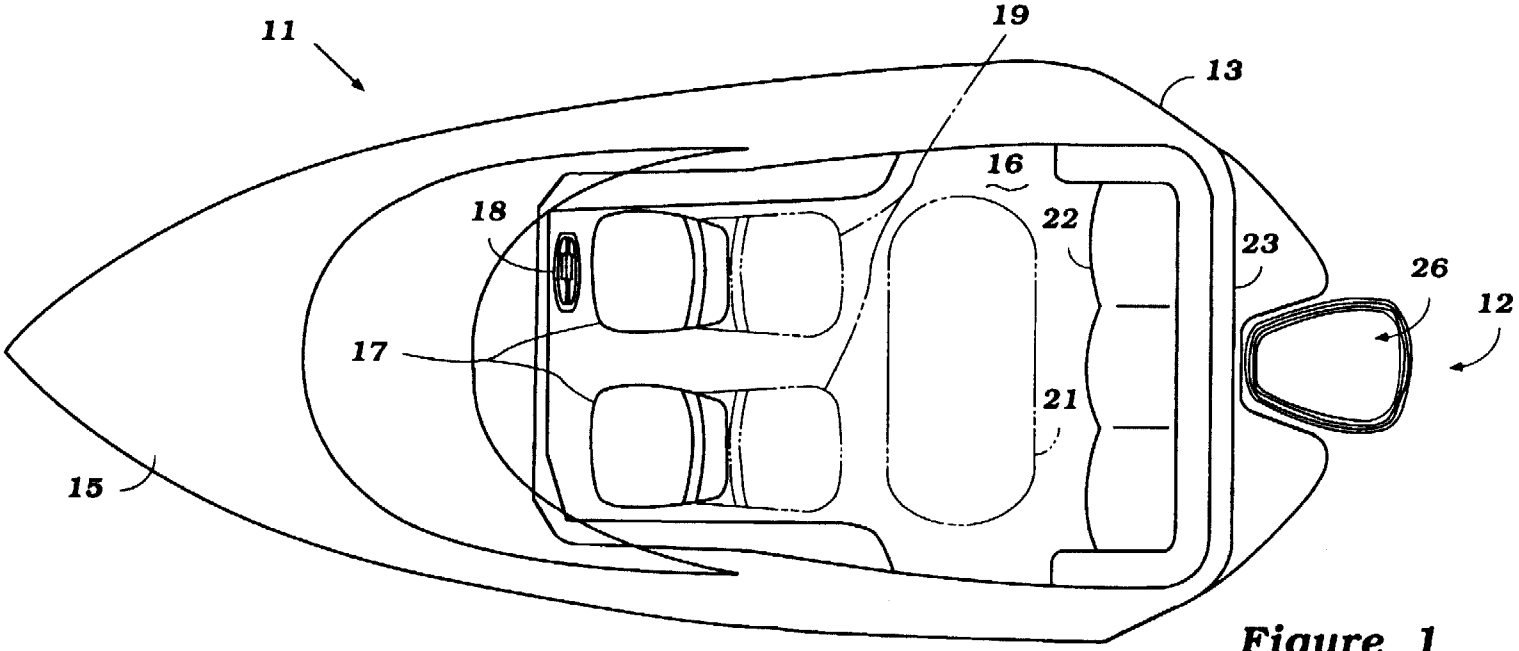
FIG. 1 is a top plan view of a jet propelled watercraft constructed in accordance with an embodiment of the invention.
Figure 2:
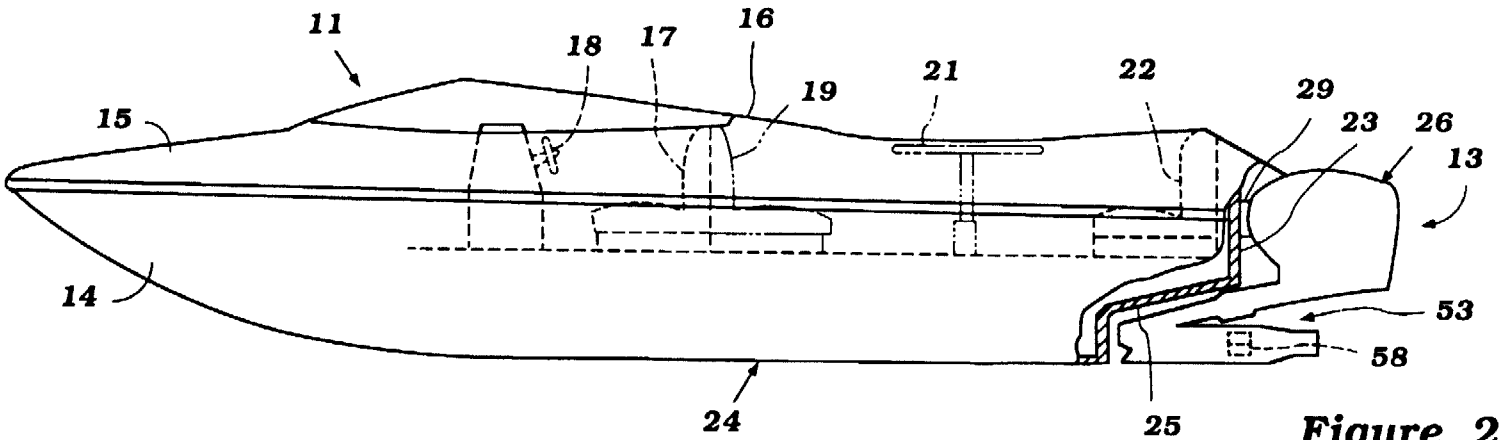
FIG. 2 is an side elevational view of the watercraft.

Referring now in detail to the drawings and initially to FIGS. 1 and 2, a jet propelled watercraft powered by an outboard jet propulsion drive is identified generally by the reference numeral 11 and the jet propulsion unit therefor is indicated generally by the reference numeral 12. The jet propulsion unit 12 is adapted to be embodied with a wide variety of types of watercraft. It is to be understood that the watercraft 11 and particularly its configuration is merely typical of those types of watercraft with which the invention may be practiced. As will become apparent, however, there are certain features of the watercraft 11 that particularly lend themselves to utilizing the outboard drive 12.

The watercraft 11 is comprised of a hull 13 which is comprised of a lower hull portion 14 and an upper deck portion 15, with the portions 14 and 15 being formed from any suitable material such as a molded fiberglass reinforced resin or the like. The deck portion 15 is provided with a cockpit or passengers' area 16 to the rear thereof, which may contain a variety of types of seating and passenger arrangements.

This can include, as illustrated, a pair of forwardly facing seats 17 provided at the front of the passengers' area 16, and one of which is disposed behind a control 18. A pair of rearwardly facing seats 19 can be mounted behind the front seat 17 and face an open area in which a table 21 can be positioned. To the rear of the table, the passengers' area 16 is provided with an elongated transversely extending seat 22. As a result of this construction, it should be apparent that the watercraft 11 can accommodate a number of passengers in different seated positions. As has been noted, however, this arrangement is merely exemplary of one of many types of passenger configurations that can be employed in conjunction with the invention.

The hull 15, and particularly the under portion 14, is provided with a transom 23 that is disposed at the rear of the passengers' area 16. There is provided forwardly of the transom 23 an undersurface, indicated generally by the reference numeral 24, which may have any configuration such as a V-bottom. At the rear of the under portion 24 and immediately adjacent the transom 23, the undersurface 24 is provided with a recessed area 25, which need not extend transversely across the transom 23 but can be positioned only centrally thereof so as to accommodate a portion of the outboard drive 12. This construction will now be described in more detail by reference to FIGS. 3 and 4, but certain portions of the construction also appear in FIGS. 1 and 2.

The outboard drive 12 is generally similar to an outboard motor but has some significant variations from conventional outboard motors, as will become apparent. The outboard drive 12 is comprised of a power head, indicated generally by the reference numeral 26, which power head is comprised of a powering internal combustion engine, indicated generally by the reference numeral 27, and a surrounding protective cowling. This protective cowling comprises a lower housing portion 28 which may be formed as a casting of a lightweight material such as aluminum or aluminum alloy. An elastic body 29 is affixed to the front of the lower casing 28 and to a mounting plate 31 that is adapted to be affixed in any suitable manner to the transom 23, with the power head 26 being disposed generally rearwardly of the transom 23, as with certain types of outboard motors.

The protective cowling for the engine 27 also includes an upper cover member 32 that is adapted to be detachably affixed to the lower housing 28 in any suitable manner so as to be opened for accessing and servicing of the engine 27.

The engine 27 is, in the illustrated embodiment, depicted as being of the two cylinder, in-line, crankcase compression two cycle type. It will be apparent to those skilled in the art, however, that various other types of engines may be employed, including engines of other cylinder numbers, other cylinder configurations, and engines operating on four-stroke rather than two-stroke principles. Furthermore, the invention may be employed with rotary engines.

The engine 27 includes a cylinder block 33 in which two horizontally extending cylinder bores 34 are positioned one above the other. Pistons 35 reciprocate within the cylinder bores 34 and are connected by means of connecting rods 36 to a crankshaft 37. As is typical with outboard motor practice, the crankshaft 37 is journaled for rotation within a crankcase chamber 38 in a known manner about a vertically extending axis. The engine 27, and specifically its cylinder block 33, is mounted in any suitable manner on the lower housing 28.

As is typical with two-cycle engine practice, the crankcase chamber 38 is provided with a pair of chamber sections, each associated with a respective one of the cylinder bores 34. An intake charge is delivered to these crankcase chambers by an induction system that includes a pair of charge formers such as carburetors 39 which receive air from an air inlet device 41 positioned at the forward end of the housing member 28. This charge is then delivered to the crankcase chambers through an induction manifold 42, which can include read-type check valves (not shown) so as to permit the charge to be drawn into the crankcase chambers 38 and compressed therein without resulting reverse flow.

The charge which has been admitted to the crankcase chambers 38 is then transferred to combustion chambers 43 formed in part by a cylinder head assembly 44 that is affixed to the cylinder block 33 in a known manner, the cylinder bores 33, and the heads of the pistons 35.

Spark plugs 45 are mounted in the cylinder head 44 in a known manner and are fired to ignite the charge in the combustion chambers 43. This charge then expands and drives the pistons 35 downwardly so as to drive the crankshaft 37 in a well-known manner. The exhaust gases are discharged through exhaust ports (not shown) and into an exhaust system 46 contained within the housing member 28 beneath the engine 27. This exhaust system 46 may be of any known type, and the exhaust gases are then discharged to the atmosphere in a suitable manner.

It is to be understood that the construction of the engine 27 as thus far described has been for illustrative purposes only. As has been noted, the invention can be utilized with a wide variety of engine types.

In accordance with the invention, the lower portion of the housing 28 is provided with a forwardly extending tubular part 47 in which a first drive shaft section 48 is rotatably journaled on a pair of spaced-apart bearings 49. This drive shaft section 48 is driven by a bevel gear transmission that is comprised of a first bevel gear 51 affixed to the lower end of the crankshaft 37 and a second bevel gear 52 that is affixed to the input end of the drive shaft section 48. It should be noted that the drive shaft section 48 extends generally forwardly and is inclined downwardly in a forward direction. This drive shaft section 48 is positioned in substantial part to the rear of the transom 23.

The drive shaft section 48 drives a jet propulsion unit, which is indicated generally by the reference numeral 53, and which has a construction that will now be described by continuing reference to FIGS. 3 and 4. This jet propulsion unit includes an outer housing, indicated generally by the reference numeral 54, and which comprises either one or more members affixed to each other in a suitable manner. This outer housing assembly 54 forms a downwardly facing water inlet opening 55 that is formed at the inlet end of an inlet duct 56 that extends through the housing 54 from the inlet opening 55 to an impeller housing 57. An impeller 58 is journaled therein on an impeller shaft 59 that extends forwardly. It should be noted that in the normal mounted conditions of the unit 12, the jet propulsion unit water inlet opening 55, inlet duct 56, and impeller housing 57 are all disposed forwardly of the transom.

The impeller shaft 59 is driven by a second drive shaft section 61 that is journaled by a pair of spaced bearings 62 in the jet propulsion unit housing 54. This drive is accomplished by a bevel gear transmission 60 first bevel gear that is affixed to one end of the second drive shaft section 61 and a second bevel gear that is affixed to the impeller shaft 59.

The second drive shaft section 61 is coupled to the first drive shaft section 48 by a universal joint, indicated generally by the reference numeral 63. This universal joint 63 is surrounded by a flexible boot 64.

The jet propulsion unit housing 54 is pivotally connected to the housing member 28 by means of a trunnion-type connection (not shown) that defines a transversely extending pivot axis that is disposed generally in line with the rear of the transom 23 for a reason which will be described. The universal joint 63 and flexible boot 64 permits this pivotal movement and the universal joint 63 defines a pivot axis lying one,he pivot axis between the housings 28 and 54.

Continuing now to describe the jet propulsion unit 53, the rear end of the impeller shaft 59 is journaled by a pair of spaced-apart bearings 65 in a nacel 66 formed by a plurality of straightening vanes 67 positioned to the rear of the impeller 58. The impeller 58 draws water through the inlet opening 55, as shown by the arrow 68 in FIG. 3, and discharges it rearwardly past the straightening vane 67 to a discharge nozzle portion 69. The discharge nozzle portion 69, in turn, discharges the water through a steering nozzle 71 in the direction of the arrow 72. The steering nozzle 71 may be pivotally connected to the discharge nozzle 69 in a manner well known in this art for effecting steering of the watercraft.

Figure 3:
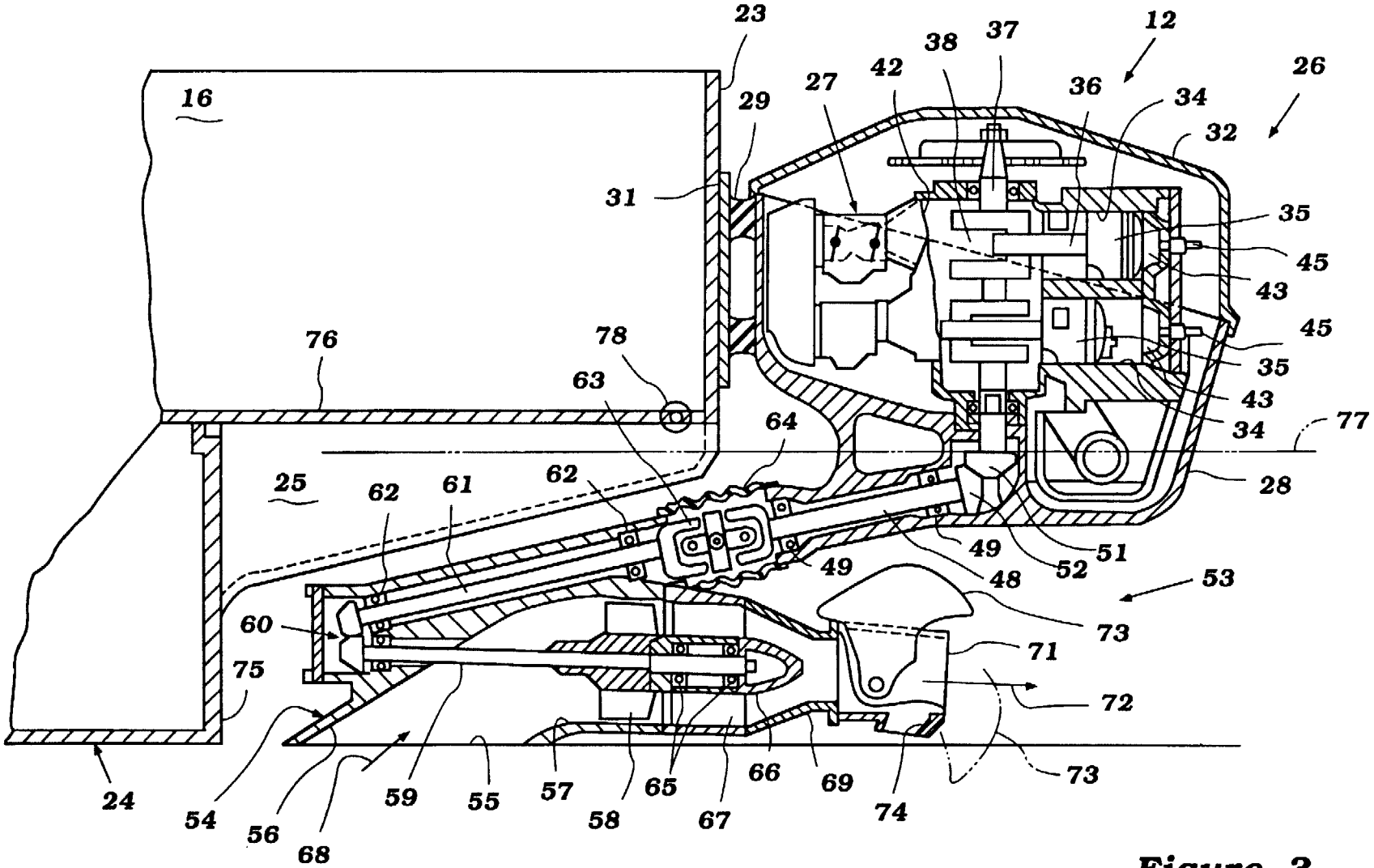
FIG. 3 is an enlarged cross-sectional view taken through the rear of the watercraft and outboard jet propulsion unit, with the jet propulsion unit shown in its normal driving condition.
Figure 4:
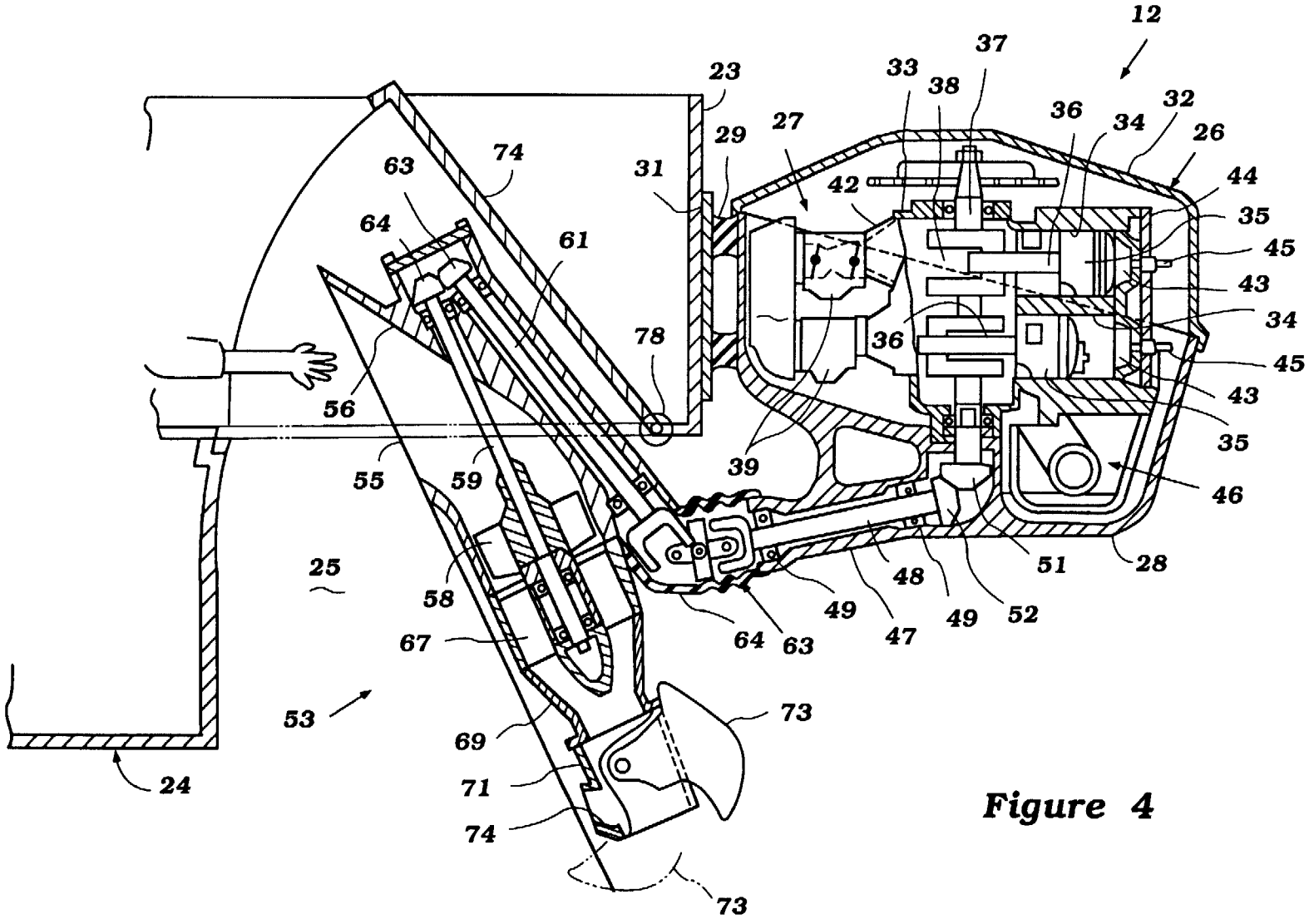
FIG. 4 is a cross-sectional view, in part similar to FIG. 3, and shows the jet propulsion unit tilted up for servicing operation.

A reverse thrust bucket assembly 73 is mounted on the end of the steering nozzle 71 and is pivotal from a forward drive position, as shown in solid line views in the figures, and a reverse thrust position, as shown in phantom line views in FIGS. 3 and 4. In this reverse thrust position, the water pumped by the impeller 58 is discharged in a forward direction through a reverse thrust discharge port 74 formed in the lower end of the steering nozzle 71. The reverse thrust bucket 73 is not operated in any known manner.

As may be seen in FIG. 3, the water inlet opening 55 of the jet propulsion unit 54 is positioned well forward of the transom 23 and immediately adjacent a forward wall 74 of the recessed area 25. As a result, the water that is drawn into the water inlet opening 55 will be relatively undisturbed, and the efficiency of the jet propulsion unit 54 will be significantly improved than if the water inlet opening 55 was disposed rearwardly of the transom. Also, because the discharge nozzle 69 and steering nozzle 71 are beneath the engine 27, a neat and compact construction will result.

The pivotal connection between the housing 28 and jet propulsion unit 54 accommodated by the universal joint 63 and flexible boot 64 is utilized so as to permit the jet propulsion unit 54 to be pivoted up, as shown in FIG. 4, to a service position. In order to permit this, a floor panel 76 of the passengers' compartment 16 is positioned above the water level when the watercraft is stationary, indicated by the line 77. This panel 76 is pivotally connected to the hull above the recessed portion 25 by a pivot pin 78 and can be swung up, as shown in FIG. 4 to open an access opening. When this is done, then an operator may reach down through the opening, grasp the jet propulsion unit 54, and pivot it upwardly so that the inlet opening 55 of the jet propulsion unit can be cleaned and any debris can be removed from the water inlet duct 56. In addition, the jet propulsion unit 53 may be stored in this upward position when the watercraft is stationary so that any water can drain down from the inlet portion. This would be akin to tilting up a conventional outboard motor when it is not in use.

From the foregoing description is should be readily apparent that the described embodiment of the invention provides a very neat and highly efficient jet propulsion unit for a watercraft which can be mounted on the transom but which will not have the disadvantages of poor pumping efficiency typical with more conventional outboard jet propulsion units. In addition, because of the unique pivotal arrangement for the jet propulsion unit, it can be readily serviced from within the watercraft. Of course, the foregoing description is that of a preferred embodiment of the invention, and various changes and modifications may be made without departing from the spirit and scope of the invention as defined by the appended claims.

I claim:

1. A jet propulsion system for a watercraft comprised of a hull having a transom and a hull undersurface disposed forwardly of said transom, said jet propulsion system comprising an internal combustion engine having an output shaft, an engine mount for mounting said internal combustion engine on the transom and with said output shaft disposed to the rear of said transom, a jet propulsion unit comprised of an outer housing defining a water inlet opening at the beginning of a closed inlet channel, a rearwardly facing discharge opening and an impeller cavity, an impeller journaled within said impeller cavity for pumping water from said inlet opening to said discharge opening for generating a propulsion force to the watercraft, means for mounting said jet propulsion unit outer housing from said engine mount and beneath said engine with at least said water inlet opening of said outer housing extending forwardly of said transom and at least in part beneath said hull undersurface, and transmission means for driving said impeller from said engine including a driving connection to said impeller positioned beneath said hull and forwardly of said impeller.

2. A jet propulsion system as in claim 1, wherein the discharge opening of the jet propulsion unit is disposed rearwardly of the transom and beneath the engine.

3. A jet propulsion system as in claim 1, wherein the engine has its output shaft rotating about a vertically extending axis.

4. A jet propulsion system for a watercraft comprised of a hull having a transom and a hull undersurface disposed forwardly of said transom with a recess in said hull undersurface disposed forwardly of said transom, said jet propulsion system comprising an internal combustion engine, an engine mount for mounting said internal combustion engine on the transom and at least in part to the rear thereof, a jet propulsion unit comprised of an outer housing defining a generally downwardly facing water inlet opening, a rearwardly facing discharge opening and an impeller cavity, an impeller journaled within said impeller cavity for pumping water from said inlet opening to said discharge opening for generating a propulsion force to the watercraft, means for mounting said jet propulsion unit from said engine mount and beneath said engine with at least said water inlet opening and extending forwardly of said transom and at least in part beneath said hull undersurface and into said recess, and transmission means for driving said impeller from said engine, said impeller and said impeller cavity also being positioned beneath the undersurface and forwardly of the transom within said recess.

5. A jet propulsion system a watercraft comprised of a hull having a transom and a hull undersurface disposed forwardly of said transom, said jet propulsion system comprising an internal combustion engine, an engine mount for mounting said internal combustion engine on the transom and at least in part to the rear thereof and having an engine output shaft rotating about a vertically extending axis, a jet propulsion unit comprised of an outer housing defining a generally downwardly facing water inlet opening, a rearwardly facing discharge opening and an impeller cavity, an impeller journaled within said impeller cavity for pumping water from said inlet opening to said discharge opening for generating a propulsion force to the watercraft, means for mounting said jet propulsion unit from said engine mount and beneath said engine with at least said water inlet opening and extending forwardly of said transom and at least in part beneath said hull undersurface, and transmission means for driving said impeller from said engine output shaft comprising a drive shaft driven by the lower end of said engine output shaft through a bevel gear transmission and extending downwardly and forwardly to the area beneath said hull undersurface and forwardly of said transom.

6. A jet propulsion system as in claim 5, wherein the drive shaft has a further bevel gear transmission at its forward end for driving the impeller through an impeller shaft that extends forwardly from the impeller through the water inlet opening of the jet propulsion unit outer housing.

7. A jet propulsion system as in claim 6, wherein the hull undersurface is provided with a recess forward of the transom and into which the jet propulsion unit extends.

8. A jet propulsion system as in claim 7, wherein the impeller and the impeller cavity are also positioned beneath the undersurface and forwardly of the transom.

9. A jet propulsion system as in claim 7, wherein the discharge opening of the jet propulsion unit is disposed rearwardly of the transom and beneath the engine.

10. A jet propulsion system as in claim 9, wherein the hull undersurface is provided with a recess forward of the transom and into which the jet propulsion unit extends.

11. A jet propulsion system as in claim 5, wherein the drive shaft is comprised of two sections interconnected by a universal joint.

12. A jet propulsion system as in claim 11, wherein the means for mounting the jet propulsion unit from the engine includes means providing a pivotal connection therebetween about a transversely extending, horizontally disposed pivot axis aligned with the universal joint.

13. A jet propulsion system as in claim 12, wherein the hull is provided with an access opening therein through which the jet propulsion unit water inlet opening extends at least in part when pivoted about its pivotal connection to the engine mount.

14. A jet propulsion system as in claim 13, wherein the access opening in the hull is disposed above the water level when the hull is floating in a body of water.

15. A jet propulsion system as in claim 14, wherein the drive shaft has a further bevel gear transmission at its forward end for driving the impeller through an impeller shaft that extends rearwardly through the water inlet opening of the jet propulsion unit outer housing.

16. A jet propulsion system as in claim 12, wherein the pivot axis is disposed rearwardly of the water inlet opening of the jet propulsion unit.

17. A jet propulsion system as in claim 16, wherein the pivot axis is disposed rearwardly of the impeller.

18. A jet propulsion system as in claim 17, wherein the hull is provided with an access opening therein through which the jet propulsion unit water inlet opening extends at least in part when pivoted about its pivotal connection to the engine mount.

19. A jet propulsion system as in claim 18, wherein the access opening in the hull is disposed above the water level when the hull is floating in a body of water.

20. A jet propulsion system as in claim 19, wherein the pivot axis is disposed substantially in line with the transom.

21. A jet propelled watercraft comprised of a hull having an undersurface and terminating at its rear end in a transom, a recess formed in said undersurface, a jet propulsion unit comprised of an outer housing defining a downwardly facing water inlet opening, a rearwardly facing discharge nozzle to the rear of said water inlet opening and an impeller cavity for containing an impeller for pumping water from said inlet opening through said discharge nozzle, support means for supporting said jet propulsion unit at least in part within said recess for pivotal movement relative to said hull about an axis extending transversely to said hull and disposed rearwardly of said water inlet opening for raising said water inlet opening out of the body of water in which the watercraft is operating.

22. A jet propelled watercraft as in claim 21, wherein the hull is provided with an access opening therein through which the jet propulsion unit water inlet opening extends at least in part when pivoted about its pivotal connection to the hull.

23. A jet propelled watercraft as in claim 22, wherein the access opening in the hull is disposed above the water level when the hull is floating in a body of water.

24. A jet propelled watercraft as in claim 21, wherein the pivot axis is disposed substantially in line with the transom.

25. A jet propelled watercraft as in claim 24, wherein the hull is provided with an access opening therein through which the jet propulsion unit water inlet opening extends at least in part when pivoted about its pivotal connection to the engine mount.

26. A jet propelled watercraft as in claim 25, wherein the access opening in the hull is disposed above the water level when the hull is floating in a body of water.

27. A jet propelled watercraft as in claim 24, further including an internal combustion engine supported on the transom to the rear thereof and transmission means for driving the impeller from said engine.

28. A jet propelled watercraft as in claim 27, wherein the transmission means includes a drive shaft having a universal joint disposed on the pivot axis.

* * * * *